US006569366B1

(12) United States Patent
Toyohara et al.

(10) Patent No.: US 6,569,366 B1
(45) Date of Patent: May 27, 2003

(54) PROCESS FOR PRODUCING META-TYPE WHOLLY AROMATIC POLYAMIDE FILAMENTS

(75) Inventors: Kiyotsuna Toyohara, Iwakuni (JP); Jiro Sadanobu, Iwakuni (JP); Tsutomu Nakamura, Iwakuni (JP)

(73) Assignee: Teijin Limited, Osaka (JP)

( * ) Notice: Subject to any disclaimer, the term of this patent is extended or adjusted under 35 U.S.C. 154(b) by 0 days.

(21) Appl. No.: 09/958,900

(22) PCT Filed: Feb. 16, 2001

(86) PCT No.: PCT/JP01/01138

§ 371 (c)(1),
(2), (4) Date: Oct. 15, 2001

(87) PCT Pub. No.: WO01/61086

PCT Pub. Date: Aug. 23, 2001

(30) Foreign Application Priority Data

Feb. 16, 2000 (JP) ..... 2000-037966
Feb. 16, 2000 (JP) ..... 2000-037967

(51) Int. Cl.[7] ..... D01D 5/06; D01D 5/12; D01D 5/247; D01D 10/02; D01F 6/60

(52) U.S. Cl. ..... 264/48; 264/178 F; 264/184; 264/210.7; 264/210.8; 264/211.15; 264/211.16; 264/211.17; 264/233; 264/235.6

(58) Field of Search ..... 264/41, 48, 178 F, 264/184, 210.7, 210.8, 211.15, 211.16, 211.17, 233, 235.6

(56) References Cited

U.S. PATENT DOCUMENTS 3,006,899 A 10/1961 Hill, Jr. et al.
3,063,966 A 11/1962 Kwolek et al.
3,360,595 A 12/1967 Wittels
3,695,992 A 10/1972 Moulds
3,760,054 A 9/1973 Moulds
4,755,335 A * 7/1988 Ghorashi ..... 264/48
5,643,518 A 7/1997 Yang et al.

FOREIGN PATENT DOCUMENTS

| | | |
|---|---|---|
| JP | 35-14399 | 9/1960 |
| JP | 47-10863 B | 3/1972 |
| JP | 48-17551 B | 5/1973 |
| JP | 50-52167 A | 5/1975 |
| JP | 52-43930 A | 11/1977 |
| JP | 56-31009 A | 3/1981 |
| JP | 8-74121 A | 3/1996 |
| JP | 8-74122 A | 3/1996 |
| JP | 8-260238 A | 10/1996 |
| JP | 10-88421 A | 4/1998 |
| WO | 97/45507 A1 | 11/1997 |

OTHER PUBLICATIONS

International Search Report (Mailed on May 22, 2001).

* cited by examiner

*Primary Examiner*—Leo B. Tentoni
(74) *Attorney, Agent, or Firm*—Sughrue Mion, PLLC

(57) ABSTRACT

A meta-type wholly aromatic polyamide containing, as principal repeating units, meta-phenylenediamineisophthalamide units is dissolved in an amide compound solvent; the resultant polymer solution is subjected to a wet-spinning procedure wherein the polymer solution is extruded in the form of filamentary streams into a coagulation bath containing an amide compound-containing solvent and water but substantially not containing salts, through spinning orifices of a spinneret, to coagulate the extruded filamentary polymer solution streams in the coagulation bath; the coagulated porous undrawn filaments are subjected to a drawing procedure wherein the porous undrawn filaments are drawn in a plasticizing drawing bath containing an aqueous solution of an amide compound solvent; the resultant drawn filaments are washed with water, and then heat-treated (for example, further drawn at a draw ratio of 0.7 to 4.0 while being heated at a temperature of 250 to 400° C.), to provide uniform and dense meta-type wholly aromatic polyamide fibers.

11 Claims, No Drawings

PROCESS FOR PRODUCING META-TYPE WHOLLY AROMATIC POLYAMIDE FILAMENTS

TECHNICAL FIELD

The present invention relates to a process for producing meta-type wholly aromatic polyamide filaments comprising, as principal repeating units, metaphenylenediamineisophthalamide units and having good mechanical properties and heat resistance, with high productivity, and wholly aromatic polyamide filaments produced by the process.

BACKGROUND ART

It is well known that wholly aromatic polyamides produced by poly-condensing aromatic diamines with aromatic dicarboxylic acid dichloride exhibit excellent heat resistance and flame-retardance. Also, it is known that the above-mentioned wholly aromatic polyamides are soluble in amide compound solvents and that from the solution of the polymer dissolved in the solvent, filaments can be produced by a dry-spinning, a wet-spinning or a semidry-semiwet-spinning method.

Among the above-mentioned wholly aromatic polyamides, meta-type wholly aromatic polyamides, which will be referred to as meta-aramids hereinafter and a representative of which is polymetaphenyleneisophthalamide, are used for producing filaments which are useful as heat-resistant, flame-retardant filaments. It is known that the above-mentioned heat resistant, flame retardant meta-aramid filaments are industrially produced by the methods (a) and (b) indicated below.

(a) A method in which a solution of polymetaphenyleneisophthalamide is prepared by subjecting metaphenylenediamine and isophthalic acid chloride to a low-temperature solution polymerization procedure in N,N-dimethylacetamide; hydrochloric acid contained, as a by-product, in the resultant polymer solution is neutralized with calcium hydroxide; the polymer solution containing the produced calcium chloride is subjected to a dry-spinning procedure to produce polymetaphenylenediamine isophthalamide filaments. (Japanese Examined Patent Publication No. 35-14,399, U.S. Pat. No. 3,360,595)

(b) A method in which a polymerization reaction system prepared by poly-condensing a meta-phenylenediamine salt and isophthalic acid chloride is brought into contact with and mixed with an aqueous liquid system comprising an organic solvent (for example, tetrahydrofuran) which is not a good solvent for the target polyamide, an inorganic acid-acceptor and a water-soluble neutral salt, to produce particles of polymetaphenyleneisophthalamide; the polymer particles are separated from the mixture system (Japanese Examined Patent Publication No. 47-10,863); the separated polymer particles are dissolved in an amide compound solvent; and the resultant polymer solution is subjected to a wet-spinning procedure in an aqueous coagulation bath containing an inorganic salt (Japanese Examined Patent Publication No. 48-17,551)

Beside the above-mentioned methods (a) and (b), the following methods (c) to (f) have been proposed as methods of producing meta-aramid filaments.

(c) A method in which a solution of a meta-aramid prepared by dissolving a meta-aramid produced by a solution polymerization method in an amide compound solvent and not containing inorganic salts or containing a small amount (2 to 3%) of lithium chloride, is subjected to a wet-shaping procedure to produce shaped articles, for example, filaments. (Japanese Examined Patent Publication No. 50-52,167)

(d) A method in which a meta-aramid solution produced by a solution polymerization in an amide compound solvent is neutralized with calcium hydroxide or calcium oxide; the resultant meta-aramid polymer solution containing calcium chloride and water is extruded into a gas atmosphere through orifices; the extruded filamentary polymer solution streams are passed through a gas atmosphere and introduced into an aqueous coagulation bath to coagulate the polymer solution streams into solid filament form; the coagulated filamentary products are passed through an aqueous solution of an inorganic salt, for example, calcium chloride, to produce meta-aramid filaments. (Japanese Unexamined Patent Publication No. 56-31,009)

(e) A method in which a meta-aramid solution produced by a solution polymerization in an amide compound solvent is neutralized with calcium hydroxide or calcium oxide; the resultant meta-aramid polymer solution containing calcium chloride and water is subjected to a wet spinning procedure, through spinning orifices, in an aqueous coagulation bath containing calcium chloride in a high concentration, to form filaments. (Japanese Unexamined Patent Publications No. 8-074,121 and No. 10-88,421)

(f) A method in which a solution of a meta-aramid containing an inorganic salt is extruded in the form of filamentary streams into a spinning chimney having a high temperature; immediately after the resultant meta-aramid filaments are withdrawn from spinning chimney, the filaments are cooled with a low temperature aqueous solution to cause the filaments to be swollen with water; the water-swollen meta-aramide filaments are drawn in an aqueous drawing bath containing a salt capable of plasticizing the filaments, to thereby produce easy-dyeable porous filaments having a plurality of very fine pores and exhibiting a bulk density of 1.3 or less. (Japanese Examined Patent Publication No. 52-43,930)

The above-mentioned method (a) is advantageous in that a polymer solution (a material solution for a spinning procedure) for a spinning procedure can be prepared without isolating the polymer from the polymerization system, but disadvantageous in that, because a dry-spinning procedure using an amide compound solvent having a high boiling temperature is employed, a necessary production cost is high and the stability of the spinning procedure is significantly decreased with an increase in the number of the spinning orifices per spinneret. Also, when the polymer solution is wet-spun in an aqueous coagulation bath, only filaments which are opaque and have a low mechanical strength may be obtained. Thus, there are many difficulties in the method in which the meta-aramid polymer solution obtained by the solution polymerization is subjected to a wet-spinning procedure using a aqueous coagulation bath, and therefore, this wet-spinning method has not yet been utilized in industry.

On the other hand, in the methods (b) and (c), although the problems occurring in the method (a) can be avoided, the resultant filaments are unsatisfactory in the structural density of the filaments.

Also, in the method (d), in the spinning procedure in which the polymer solution is extruded through a spinneret into the air, the stability of the spinning procedure is significantly decreased with an increase in the number of the orifices per spinneret, and thus this method has low productivity and efficiency.

Further, in the method (e), there is a problem such that although the resultant filaments exhibit good properties, it is difficult to carry out the method (e) at a high spinning rate, and thus the productivity of the method (e) is low.

The method (f) is utilized to produce porous filaments having a bulk density significantly less than 1.3. However, the method (f) is a variation of the dry-spinning method and thus has the same problems as those of the dry-spinning method.

Meta-aramid filaments can be used for electronic materials in which the excellent heat resistance and insulation property of the filaments are utilized. In this case, to employ the filaments for the electronic materials, the contamination of ionic substances in the filaments must be as low as possible, and if possible, the filaments preferably contain no inorganic ionic substances. However, in the conventional production processes, it is unavoidable that, in the filament-forming procedures, the polymer solution and the coagulation bath contains salts, for example, calcium chloride or lithium chloride which have high affinities to the polymer dope and is easily soluble in the polymer dope, in a high concentration. Therefore, there is a problem such that contamination of the resultant filaments with a large amount of salts cannot be prevented. To remove the salts from the filaments, a large scale of water-washing procedure must be applied to the filaments, and even when this is applied, it is very difficult to completely remove the salts from the filaments.

Accordingly, a development of a new process capable of producing meta-aramid filaments having satisfactory filament properties in practice and, if necessary, containing no salts, with high productivity, is required.

DISCLOSURE OF THE INVENTION

The principal object of the present invention is to provide a new process for producing meta-aramid filaments exhibiting excellent mechanical properties and thermal properties, having a dense structure and optionally containing no salts, with high productivity, with an industrial advantage, and dense meta-aramid filaments produced by the process.

The process of the present invention for producing meta-type wholly aromatic polyamide filaments comprises the steps of preparing a polymer solution by dissolving a meta-type wholly aromatic polyamide comprising, as principal repeating units, metaphenylene diamine isophthalamide units, in an amide compound solvent; subjecting the polymer solution to a wet-spinning procedure to form undrawn filaments; drawing the undrawn filaments; washing the resultant drawn filaments with water; and heat-treating the washed filaments, wherein (1) in the wet-spinning step, the polymer solution is extruded in the form of filamentary streams into a coagulation bath comprising an amide compound-containing solvent and water but substantially not comprising salts, through spinning orifices of a spinneret, to coagulate the filamentary polymer solution streams in the coagulation bath and to form coagulated porous undrawn filaments, and (2) in the drawing step, the coagulated porous undrawn filaments are drawn in a plasticizing drawing bath comprising an aqueous solution of an amide compound solvent.

In the process of the present invention for producing meta-type wholly aromatic polyamide filaments, the meta-type wholly aromatic polyamide preferably contains the repeating metaphenylenediamine isophthalamide units in a molar amount of 90 to 100 molar % based on the total molar amount of all the repeating units.

In the process of the present invention for producing meta-type wholly aromatic polyamide filaments, the coagulation bath, used in the wet-spinning step, preferably contains the amide compound solvent and water in a mixing weight ratio within the range of from 20/80 to 70/20.

In the wet-spinning step of the process of the present invention for producing meta-type wholly aromatic polyamide filaments, the bulk density of the resultant coagulated porous undrawn filaments is controlled to be from 0.3 to 1.0 $g/cm^3$.

In the process of the present invention for producing meta-type wholly aromatic polyamide filaments, the amide compound solvent and water in the drawing bath are preferably present in a mixing weight ratio in the range from 20/80 to 70/30.

In the drawing step of the process of the present invention for producing meta-type wholly aromatic polyamide filaments, the drawing bath preferably has a temperature of 20 to 90° C., and the coagulated porous undrawn filaments is preferably drawn at a draw ratio of from 1.5 to 10.

In the heat-treating step of the process of the present invention for producing meta-type wholly aromatic polyamide filaments, the drawn, water-washed filaments are preferably further drawn at a temperature in the range of from 250 to 400° C. at a draw ratio in the range of from 0.7 to 4.0.

In the process of the present invention for producing meta-type wholly aromatic polyamide filaments, preferably, the amide compound solvent contained in the polymer solution and the amide compound solvent contained in the coagulation bath respectively and independently from each other comprise at least one member selected from the group consisting of N-methyl-2-pyrrolidone, dimethylacetamide, dimethylformamide and dimethylimidazolinone.

In the process of the present invention for producing meta-type wholly aromatic polyamide filaments, the heat-treated filaments preferably have a bulk density of 1.2 or more.

In the process of the present invention for producing meta-type wholly aromatic polyamide filaments, the total content of inorganic ionic substances contained in the polymer solution for the wet-spinning step, is preferably controlled to 0.1% by weight or less.

In the process of the present invention for producing meta-type wholly aromatic polyamide filaments, the polymer solution for the wet-spinning step may be prepared by poly-condensing an aromatic diamine compound with an aromatic dicarboxylic acid chloride, and neutralizing the hydrogen chloride produced, as a by-product, with a basic calcium compound, and may comprise the meta-type wholly aromatic polyamide, calcium chloride and water.

The meta-type wholly aromatic polyamide filaments of the present invention include those produced by the process of the present invention as mentioned above.

The meta-type wholly aromatic polyamide filaments of the present invention preferably have a bulk density of 1.2 or more.

The meta-type wholly aromatic polyamide filaments of the present invention include those produced by the process of the present invention in which the total content of the inorganic ionic substances contained in the polymer solution supplied to the wet-spinning step is controlled to less than 0.1% by weight.

In the meta-type wholly aromatic polyamide filaments of the present invention, the total content of inorganic ionic substances contained in the filaments is preferably 500 ppm or less.

In the meta-type wholly aromatic polyamide filaments of the present invention, the total contents of calcium contained in the filaments is preferably 100 ppm or less.

In the meta-type wholly aromatic polyamide filaments of the present invention, the total contents of chlorides contained in the filaments is preferably 150 ppm or less.

The meta-type wholly aromatic polyamide filaments of the present invention include those produced by the process of the present invention in which the polymer solution for the wet-spinning step is obtained by poly-condensing the aromatic diamine compound with the aromatic dicarboxylic acid chloride in the amide compound solvent and by neutralizing hydrogen chloride produced as a by-product with a basic calcium compound, and contains the meta-type wholly aromatic polyamide, calcium chloride and water.

The above-mentioned meta-type wholly aromatic polyamide filaments of the present invention preferably have a tensile strength of 3.53 cN/dtex (4.0 g/de) or more.

BEST MODE OF CARRYING OUT THE INVENTION

The process of the present invention comprises steps of preparing a polymer solution by dissolving a meta-type wholly aromatic polyamide comprising, as principal repeating units, metaphenylenediamine isophthalamide units, in an amide compound solvent; subjecting the polymer solution to a wet-spinning procedure to form undrawn filaments; drawing the undrawn filaments; washing the resultant drawn filaments with water; and heat-treating the water-washed filaments.

The meta-type wholly aromatic polyamide usable for the process of the present invention is one containing, as principal repeating units, metaphenylene-diamine isophthalamide units. There is no limitation to the process for producing the meta-type wholly aromatic polyamide. The polyamide is produced, for example, by employing, as principal starting materials, a meta-type aromatic diamine component and an aromatic dicarboxylic acid chloride, and by a solution polymerization or an interfacial polymerization thereof.

The meta-type aromatic diamine usable for the production of the meta-type wholly aromatic polyamide usable for the present invention is preferably selected from the diamine compounds represented by the following formula (I):

(I)

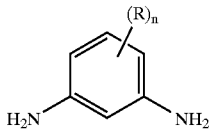

In the formula (I) shown above, R represents a halogen atom (for example, a chlorine or bromine atom) or an alkyl group having 1 to 3 carbon atoms (for example, a methyl or ethyl group), and n represents an integer of 0 or 1.

The meta-type diamines of formula (I) are preferably selected from metaphenylenediamine, 2,4-toluenediamine, 2,6-toluenediamine, 2,4-diaminochlorobenzene and 2,6-diaminochlorobenzene. Other meta-type aromatic diamines, for example, 3,4-diaminodiphenylether and 3,4-diaminodiphenylsulfone may be used for the present invention.

The meta-type aromatic diamine component usable for the present invention preferably consists of metaphenylenediamine or a diamine mixture comprising, as a main ingredient, metaphenylenediamine. The other aromatic diamines usable together with metaphenylenediamine for the diamine mixture include the meta-type aromatic diamines of the formula (1) (except for metaphenylene diamine); benzene derivatives, for example, paraphenylenediamine, 2,5-diaminochlorobenzene, 2,5-diaminobromobenzene, and aminoanisidine; and 1,5-paranaphthylenediamine, 4,4'-diaminodiphenylether, 4,4'-diaminodiphenylketone, bis(aminophenyl)phenylamine and bis(paraaminophenyl)methane.

When it is desired that the polymer used for the present invention has a high solubility, the amount of the other aromatic diamine than metaphenylenediamine is preferably about 20 molar % or less of the total molar amount of all the aromatic diamine compounds for the aromatic diamine component. Also, when it is desired that the polymer has a high crystallization property, the content of metaphenylenediamine in all the aromatic diamine component is preferably 90 molar % or more, more preferably 95 molar % or more, based on the total molar amount of the aromatic diamine component.

On the other hand, the aromatic dicarboxylic acid chloride component usable for the production of the meta-type wholly aromatic polyamide for the process of the present invention preferably comprises isophthalic acid chloride or an aromatic dicarboxylic acid chloride mixture containing, as a main ingredient, isophthalic acid chloride.

In the aromatic dicarboxylic acid chloride component, another aromatic dicarboxylic acid chloride usable together with isophthalic acid chloride for the aromatic dicarboxylic acid chloride mixture is preferably selected from, for example, terephthalic acid chloride, 1,4-naphthalene dicarboxylic acid chloride, 2,6-naphthalene dicarboxylic acid chloride, 4,4'-biphenyldicarboxylic acid chloride, 3-chloroisophthalic acid chloride, 3-methoxyisophthalic acid chloride, and bis(chlorocarbonylphenyl)ether.

In the process of the present invention, when it is desired that the polymer has a high solubility, the amount of the other aromatic dicarboxylic acid chloride to be used together with isophthalic acid chloride is preferably about 20 molar % or less, based on the total molar amount of the aromatic dicarboxylic acid chloride component. Also, when it is desired that the polymer has a high crystallization property, the content of isophtalic acid chloride in the aromatic dicarboxylic acid chloride component is preferably 90 molar % or more, more preferably 95 molar % or more.

In the polymer for the process of the present invention, the content of repeating metaphenylenediamine isophthalamide units is preferably 90 to 100 molar % based on the total repeating units in the meta-type wholly aromatic polyamide. Also, it is preferable that the polymer contains substantially no salts.

In the process of the present invention, to produce heat-resistant filaments having good mechanical properties from the above-mentioned meta-type aromatic polyamide solution, it is important to control the degree of polymerization of the polymer independently of the content of the inorganic ionic substances in the solution. Particularly, to obtain filaments having good properties from the polymetaphenylene isophthalamide polymer, the polymer preferably has an intrinsic viscosity (I.V.) of 0.8 to 4.0, more preferably 1.0 to 3.0, still more preferably 1.3 to 2.4, determined in a polymer concentration of 0.5 g/100 ml in concentrated sulfuric acid at a temperature of 30° C.

The required level for the degree of polymerization of the polymer is established in consideration of the purpose of using the polymer or the polymer solution and the use of the filaments. Thus, the degree of polymerization of the polymer can be controlled, as required, by known methods. In a typical controlling method, the degree of polymerization of the polymer can be controlled by using a terminal reaction-stopping agent (for example, aniline, alkylanilines, for example, toluidine, and benzoic acid chloride, etc.).

In the present invention, the polymer solution in which the meta-type wholly aromatic polyamide is dissolved in an amide compound solvent, and preferably, substantially no inorganic ionic substances (for example, inorganic salts) are contained, is supplied to a wet-spinning step which will be illustrated hereinafter.

The above-mentioned polymer solution containing substantially no inorganic ionic substances may be a polymer solution prepared by removing the inorganic ionic substances from the solution of the meta-type wholly aromatic polyamide in the amide compound solution, prepared by the above-mentioned solution polymerization method, etc., or by isolating the meta-type wholly aromatic polyamide from a meta-type wholly aromatic polyamide solution prepared by the solution polymerization or interface polymerization method and dissolving the isolated polyamide in an amide compound solvent. The phrase "containing substantially no inorganic ionic substances" means that the total content of the inorganic ionic substances in the polymer solution is less than 0.1% by weight. Namely, the polymer solution containing substantially no inorganic ionic substances is permitted to contain salts in a very small content which should be as small as possible and is preferably within the range of from 0 to 0.01% by weight.

In the process of the present invention, the amide compound solvent usable for the preparation of the polymer solution preferably contains N,N-dimethylformamide, N,N-dimethylacetamide, N-methyl-2-pyrrolidone, and/or dimethylimidazoline. Particularly, N-methyl-2-pyrrolidone is more preferably employed, because the resultant polymer solution exhibits an excellent stability in the procedure from the solution polymerization step to the wet-spinning step.

In the process of the present invention, the polymer solution to be fed into the wet-spinning step may contain water. The water contained in the polymer solution may be one optionally added to the polymer solution or one necessarily generated in the polymer solution-preparing step. The content of water in the polymer solution is not specifically limited as long as the resultant polymer solution can exist stably. Usually, the water is added to or contained in a content of 0 to 60% by weight, more preferably 0 to 15% by weight, based on the weight of the polymer, in the polymer solution. If the water content is more than 60% by weight, the resultant polymer solution may exhibit an insufficient stability, and thus a deposition of the polymer and/or a gelation of the polymer solution may occur, and thus the spinnability of the polymer solution may be significantly degraded.

As an embodiment of the process of the present invention, a process for producing meta-type wholly aromatic polyamide filaments containing substantially no inorganic ionic substances will be explained below.

<Wet-spinning step (1)>

In the process of the present invention, meta-type aramid filaments having excellent mechanical properties and heat resistance and containing substantially no salts can be produced with high efficiency and good productivity, by forming undrawn filaments having a porous coagulation structure in the wet-spinning step, and by densifying the porous coagulation structure of the undrawn filaments by the drawing, water-washing and heat-treatment steps applied to the undrawn filaments. The above-mentioned process of the present invention in which the undrawn filaments are densified was considered impossible in the conventional process for producing the meta-type aramid filaments, and thus is a new process.

In the embodiment of the process of the present invention, the wet-spinning step in which a polymer solution containing substantially no inorganic ionic substances is extruded through a multi-hole type spinneret preferably having 300 to 30,000 spinning orifices, and the extruded polymer solution streams are directly introduced into a coagulation bath containing substantially no salts, is carried out. The wet-spinning step mentioned above enables the meta-type aramid filaments having excellent mechanical properties and heat resistance to be produced.

In Japanese Unexamined Patent Publication No. 51-564, a wet-spinning method using a coagulation bath containing no salts is disclosed. In this method, as a coagulation bath, a polyalkyleneglycol bath is used at a high temperature, and thus meta-type aramid filaments can be produced by using the substantially salt-free coagulation bath.

In this method, however, since a polymeric compound which cannot be distilled is used as the coagulating bath, the recovery of the polymeric compound is difficult and thus the coagulation cost is high. For this reason, this method is unsuitable for industrial production of the meta-type aramid filaments. Therefore, no wet-spinning process including an inorganic coagulation bath and a recovery system thereof and capable of being utilized in industries was developed before the present invention.

In the process of the present invention, to solve the above-mentioned problems, a coagulation bath comprising a very simple composition, namely an aqueous solution of an amide compound solvent, is used to thereby coagulate the polymer solution streams to form uniform porous undrawn filaments. Namely, in the process of the present invention, the temperature of the above-mentioned polymer solution is adjusted to a level falling within the temperature range of from 20 to 90° C. and corresponding to the temperature of the coagulation bath; then the temperature-adjusted polymer solution is extruded through the above-mentioned spinneret and introduced into the coagulation bath having the composition and the temperature which will be explained hereinafter, to provide undrawn porous filaments; and then the undrawn filaments are withdrawn from the coagulation bath.

In the process of the present invention, the undrawn porous filaments are subjected to a drawing step. In the drawing step, the undrawn porous filaments are drawn in an aqueous solution of an amide compound solvent at a drawn ratio of 2 to 10. The drawn filaments are subjected to a water-washing step in which the drawn filaments were washed with water, and then dried. The dried filaments are subjected to a heat-treatment step wherein the dried filaments are heat-treated at a temperature from 250 to 400° C. Using the above-mentioned process of the present invention, meta-type aramid filaments having a dense structure and excellent physical properties can be obtained.

As mentioned above, Japanese Examined Patent Publication No. 52-43930 discloses a process for producing porous meta-type aramid filaments having a final density significantly lower than 1.3 g/cm$^2$ by procedures analogous to the dry-spinning procedures. However, in this process, dry-spinning procedures, which are definitely different in technology from the wet coagulation procedures, are used. In this process, since a procedure in which, after the dry-spinning procedure, the resultant filament is swollen in an aqueous solution containing a solvent at a low temperature, is necessary, it is difficult to produce the filaments by using a spinneret with a large number of spinning holes and thus at a high productivity. Compared with this, in the process of the present invention, the coagulation method in which the wet-spinning procedure is carried out at a temperature within a specific range under specific coagulation conditions, and thus the resultant porous filaments are uniform in quality thereof, is employed and thus a spinneret having a plurality of spinning holes can be used. Therefore, in the process of the present invention, undrawn meta-type aramid filaments having a uniform porous structure can be produced by the wet-spinning step with a high productivity.

Also, in Japanese Examined Patent Publication No. 52-43930, it is stated that the resultant porous meta-type aramid filaments produced by the process of the Japanese publication preferably has a density less than 1.18 g/cm$^3$. Therefore, the meta-type aramid filaments of the prior Japanese publication have a higher porosity than that of the meta-type aramid filaments produced as a final product of the process of the present invention.

In the process of the present invention, to densify the filament to an extent such that the densified filaments exhibit satisfactory physical properties, in the steps after the wet-spinning step, it is extremely important that the porous structure of the undrawn filaments produced by the coagulation procedure of the wet-spinning step is formed as uniform as possible.

The porous structure of the resultant undrawn filaments is closely influenced by the composition of the coagulation bath and the coagulating conditions, and thus the establishment of the composition of the coagulation bath and the coagulating conditions (for example, temperature) is very important.

The coagulation bath usable for the wet-spinning step of the process of the present invention is substantially free from inorganic ionic substances, for example, salts, and consists essentially of an aqueous solution of two components, namely an amide compound solvent and water ($H_2O$). In the coagulation bath composition, there is no limitation to the type of the amide compound for the solvent, as long as the amide compound solvent can dissolve the meta-type aramid polymer therein and is sufficiently compatible with (or soluble in) water.

The preferable amide compound solvent comprises at least one member selected from N-methyl-2-pyrrolidone, dimethylacetamide, dimethylformamide, and dimethylimidazolidinone. In consideration of the recovery of the amide compound solvent, the amide compound solvent contained in the coagulation bath is preferably the same as that contained in the polymer solution.

In the process of the present invention, the mixing ratio of the amide compound solvent to water contained in the coagulation bath is variable in response to the composition of the polymer solution and the coagulating conditions. Usually, the concentration of the amide compound solvent in the coagulation bath is preferably adjusted in the range of from 40 to 70% by weight. If the concentration of the amide compound solvent is less than 40% by weight, the resultant undrawn filaments may have large voids formed therein and may be easily broken due to the voids. Also, if the amide compound solvent concentration is more than 70% by weight, the resultant coagulation bath may exhibit a decreased coagulation rate for the polymer solution streams introduced therein and the coagulated undrawn filaments may adhere to each other.

The suitable temperature of the coagulation bath is variable in response to the composition of the coagulation liquid. Generally, when the coagulation bath temperature is high, formation of coarse air bubble-like pores, which is so-called as "fingers", in the coagulated undrawn filaments is restricted, and this phenonenon is preferred. In the case where the concentration of the solvent in the coagulation bath is high, if the coagulation bath temperature is too high, the undesirable adhesion of the undrawn filaments to each other is promoted. Thus, preferably, the temperature of the coagulation bath is in the range of from 20 to 90° C., more preferably from 30 to 80° C.

The coagulation liquid preferably consists essentially of the amide compound solvent and water. optionally, the coagulation liquid may contain a small amount of salts. Particularly, salts such as calcium chloride, and calcium hydroxide, which may be extracted from the polymer solution into the coagulation liquid, do not affect on or hinder the formation of the porous structure of the undrawn filaments. For example, when the salts are contained in a low concentration of 10% by weight or less, preferably 5% by weight or less, still more preferably 3% by weight or less, based on the total weight of the coagulation bath, no problem occurs. Accordingly, the permissible concentration of the salts is in the range of from 0 to 10% by weight, based on the weight of the coagulation liquid. The staying time of the undrawn filaments in the coagulation bath is preferably 0.1 to 30 seconds. If the staying time is too short, the formation of the undrawn filaments may be insufficiently effected and the resultant undrawn filaments may be broken.

In the wet-spinning step of the process of the present invention, a high bulk density of the resultant undrawn porous filaments causes the filament structure of the undrawn porous filaments to be smoothly densified in the steps after the wet-spinning step. Usually, the undrawn porous filaments preferably have a bulk density of 0.3 g/cm$^3$ or more, more preferably 0.5 to 1.0 g/cm$^3$. When the bulk density of the undrawn filaments is less than 0.3 g/cm$^3$, the undrawn filaments may exhibit too high a porosity and may be difficult to be sufficiently densified by the steps succeeding the wet-spinning step. The bulk density of the filaments can be determined on the basis of the volume and weight of the filaments measured in accordance with ASTM D 2130.

In the porous structure of the undrawn filaments produced by the wet-spinning step of the process of the present invention, a plurality of fine pores having an extremely high uniformity are formed.

In the porous structure, no large pores having a pore size of several $\mu$ms or more and called "fingers" are found. The fine pores has a pore size in order of 0.1 to 1 $\mu$m, namely sub-micrometer order, determined by a scattering microscope. It is known that a fine and uniform pore structure can be formed by, for example, a spinodal decomposition occurred due to coagulation. In coagulation (wet-spinning), by forming the above-mentioned uniform fine porous structure, the breakage of the resultant filaments in the drawing step can be prevented and the densification of the filament structure in the final heat-treatment step and the realization of physical properties of the filament, sufficient for practical use, can be effected.

In the process of the present invention, in the stage of extruding the polymer solution toward the coagulation bath, a spinneret having a plurality of spinning holes can be employed. In practice, the upper limit to the number of the spinning holes per spinneret is about 50,000. Preferably, the spinneret having 300 to 30,000 spinning holes is employed.

<Plasticizing Drawing Step>

In the wet-spinning step of the process of the present invention, the resultant coagulated porous undrawn filaments are successively introduced into a plasticizing drawing bath comprising an aqueous solution of an amide compound solvent and drawn at a draw ratio of 2 to 10 in the drawing bath.

The plasticizing drawing bath usable for the process of the present invention comprises an aqueous solution of an amide compound solvent. The amide compound solvent is preferably selected from those capable of swelling the meta-type wholly aromatic polyamide and of sufficiently mixing with water. Usually, the amide compound solvent preferably comprises at least one member selected from N-methyl-2-pyrrolidone, dimethylacetamide, dimethylformamide, and dimethylimidazolidinone. More preferably, the amide compound solvent for the plasticizing drawing bath is the same as that of the coagulation bath. When the amide compound solvents in the coagulation bath and in the plasticizing drawing bath are same as each other, the recovery procedure for the solvent can be simplified and an economical advantage can be obtained.

Namely, all the amide compound solvents in the polymer solution, the coagulation bath and the plasticizing drawing bath are preferably the same as each other, and one of, or a mixture of two or more of, N-methyl-2-pyrrolidone, dimethylacetamide and dimethylformamide is advantageously employed as the amide compound solvent.

The composition and temperature of the plasticizing drawing bath are variable in a close relationship to each other. Preferably, the concentration of the amide compound solvent in the aqueous amide compound solvent solution is in the range of from 20 to 70% by weight, and the temperature of the drawing bath is in the range of from 20 to 90° C. In the concentration and temperature below the lower limits of the above-mentioned ranges, the plasticization of the undrawn filaments may be insufficiently effected, and the drawing of the undrawn filaments in a sufficient draw ratio may be difficult. Also, at a concentration and a temperature above the upper limits of the above-mentioned ranges, the undrawn filaments may be dissolved at the surface portions thereof and adhered to each other, and thus the production of satisfactory drawn filaments may be difficult.

In the plasticizing drawing step of the process of the present invention, the drawing procedure is preferably carried out at a draw ratio of 1.5 to 10, more preferably 2 to 10, still more preferably 2.1 to 6.0. By carrying out the drawing procedure at the above-mentioned high draw ratio, the resultant drawn meta-type aramid filaments exhibit enhanced mechanical strength and modulus of elasticity and thus are excellent in physical properties, and simultaneously the fine pores in the undrawn filaments with the porous structure are squashed, and in the heat-treatment step applied after the plasticizing drawing step, the drawn filaments can be sufficiently densified. However, at too high a draw ratio, the smoothness of the drawing procedure may be decreased, and the drawing procedure may become difficult to carry out.

<Water-washing and Heat Treatment Steps>

The drawn filaments passed through the above-mentioned plasticizing drawing step are then washed with water, for example, with cold water, at a temperature of 30° C. or less, and then with hot water at a temperature of 50 to 90° C. Thereafter, the washed filaments are dried by a heating roller or hot blast usually at a temperature of 100° C. or more to remove water. Then, the drawn, washed filaments are heat-treated by using a heating plate or heating roller, at a temperature of 270 to 400° C.

The dry heat treatment (dry heating and additional drawing) step is an important step to densify the drawn porous filaments and to reveal sufficient mechanical strength and elongation on the drawn filaments for practically use. Particularly, the temperature of the dry heat treatment (dry-heating and additional drawing) step is variable in close relationship to the bulk density of the resultant heat treated filaments. The dry heat treatment step is preferably carried out at a temperature of 270 to 400° C., more preferably 300 to 370° C. If the heat treatment temperature exceeds 400° C., the resultant heat treated filaments may exhibit significant deterioration and discoloration and, occasionally, may be broken. If the heat treatment temperature is lower than 270° C., the drawn filaments cannot be sufficiently densified and thus may be difficult to provide suitable filament properties. It should be noted that, in the process of the present invention, the dry heat treatment temperature is represented by the established temperature on the heating means, for example, heating plate or heating roller.

In the heat treatment step of the process of the present invention, the draw ratio of the additional drawing procedure is variable in a close relationship to the modulus of elasticity and mechanical strength of the resultant drawn filaments and can be established at a desired value. Usually, when the draw ratio of the additional drawing is established at 0.7 to 3, particularly 1.0 to 2.7, the drawn filaments exhibits a good drawing property and good mechanical strength and modulus of elasticity are revealed on the heat-treated filaments. The draw ratio of 0.7 mentioned above indicates that in the heat treatment step, the filaments shrink to a length corresponding to 70% of the original length before the heat treatment, namely with a shrinkage of 30%. Namely, the heat treatment step of the process of the present invention allows the draw ratio to be less than 1.0. This means that the heat treatment step of the process of the present invention includes a heat shrinking treatment in which the drawn filaments shrink with a limited range of shrinkage. Preferably, the draw ratio for the heat treatment step is established in consideration of the draw ratio applied to the undrawn filaments in the plasticizing drawing step. In view of the densification of the drawn filaments and the provision of the desired physical properties of the filaments and stabilization of the wet-spinning step, the total of the drawing ratios of the plasticizing drawing step and the dry heat treatment step is preferably controlled to 2.5 to 12, more preferably 3.0 to 6.0.

The meta-type aramid filaments produced by the process of the present invention have a satisfactory drawability, and thus can be smoothly drawn at a high draw ratio without breakage of filaments in the plasticizing drawing step and the dry heat treatment step.

By the above-mentioned process of the present invention, meta-type aramid filaments having a tensile strength of 3.53 cN/dtex (4.0 g/de) or more can be produced.

In another embodiment of the process of the present invention, a polymer solution containing inorganic ionic substances (for example, inorganic salts) is employed as a polymer solution for the wet-spinning step. This type of polymer solution is obtained in the case where an aromatic diamine compound and an aromatic dicarboxylic acid chloride are polycondensed, and a by-product consisting of hydrogen chloride is neutralized with basic calcium compound, and contains a meta-type wholly aromatic polyamide and calcium chloride and water.

The above-mentioned polymer is produced by the above-mentioned polymerization method. When a solution polymerization method is used, as a solvent, the same amide compounds as those used in the above-mentioned embodiment, namely, N,N-dimethylformamide, N,N-dimethylacetamide, N-methyl-2-pyrrolidone and dimethylimidazolinone are employed and particularly N-methylpyrrolidone (NMP) is preferably employed.

Usually, in the solution polymerization procedure, NMP is preferably employed as a polymerization medium. After a meta-type aromatic diamine component is dissolved in NMP, an aromatic dicarboxylic acid chloride component comprising, as a main ingredient, isophthalic acid chloride, in the form of a powder or in the state of a melt, is mixed into the diamine component solution while the mixture is fully stirred to cause the diamine compound to react with the dicarboxylic acid chloride component. The reaction temperature is preferably 0 to 80° C. The amount of the polymerization medium is preferably 3 to 30% by weight of the total weight of the starting materials.

The solution of the meta-type aromatic polyamide produced in the above-mentioned manner contains hydrogen chloride in a high concentration and, thus, when the polyamide solution is neutralized with a water-soluble basic substance, for example, calcium hydroxide, sodium hydroxide or sodium (hydrogen) carbonate, the polymerization reaction is terminated, and a polymer solution of a meta-type aromatic polyamide having a preferable degree of polymerization and a high chemical stability can be obtained.

The concentration of the polymer in the inorganic ionic substance-containing polymer solution usable for the process of the present invention is shown in part by weight per 100 parts by weight of the total of the polymer and the solvent (NMP). This concentration will be referred to as "PN concentration", and the units "part by weight" will be omitted, hereinafter.

The PN concentration of the polymer in the inorganic ionic substance-containing polymer solution is preferably 10 to 30, more preferably 16 to 30. If the PN concentration is less than 10, since the concentration is too low, the resultant polymer solution may exhibit an insufficient filament-forming property.

Thus the resultant filaments may exhibit degraded performance, the degree of recycling and re-using of the solvent (NMP) may increase, and thus an economical disadvantage may occur. Also, the higher the PN concentration; the higher the transparency of the shaped product, namely the filaments. However, when the PN concentration is higher than 30, the resultant polymer solution may exhibit too high a viscosity, and thus the polymerization reaction procedure and the neutralization reaction procedure may not be smoothly carried out. Therefore, when the polymerization is carried out at a high concentration of the components, for example, at a high PN concentration of more than 30, an addition of a slurry of a neutralizing agent, for example, calcium hydroxide dispersed in NMP in an appropriate amount (for example, an amount sufficient to finally adjust the PN concentration to 25) to the reaction system in the neutralization procedure, may cause the neutralization reaction to be easily carried out, and simultaneously the concentration of the polymer (the PN concentration) in the polymerization system may be controlled.

The above-mentioned polymer solution comprises the meta-type aromatic polyamide and the amide compound solvent and further the inorganic ionic substances (salts), and optionally contains water. The water and salts mentioned above are necessarily produced during the solution polymerization procedure and may be further added to the polymer solution, if necessary. Also, when the polymer solution is prepared by another method of preparing the polymer solution, the inorganic ionic substances (salts) and water may be externally added.

The above-mentioned inorganic ionic substances (salts) include, for example, halides of alkali metals, for example, sodium chloride, sodium iodide and lithium chloride; and halides carbonates and hydroxides of alkaline earth metals, for example, calcium chloride, calcium carbonate, calcium hydroxide and magnesium chloride. There is no limitation to the concentration of the inorganic ionic substances as long as the resultant polymer solution is kept stable. Usually, the concentration of the inorganic ionic substances is preferably in the range of from 0 to 60% by weight based on the weight of the polymer, more preferably 50% by weight or less. If the concentration of the inorganic ionic substances is more than 60% by weight, the inorganic ionic substances may be deposited by the polymer solution and thus the polymer solution may exhibit a decreased stability.

The polymer solution preferably has a content of water of 0 to 20% by weight, more preferably 0 to 15% by weight, based on the total weight of the polymer solution.

When the water content is more than 20% by weight, the resultant polymer solution may exhibit an unsatisfactory stability, and thus the polymer may be deposited or gelled so that the filament-forming property of the resultant polymer solution may be significantly degraded.

Particularly, in the solution polymerization procedure, after the target polymer is produced, the solution of the polymer is neutralized by adding a neutralizing agent. The neutralizing agent usable for the neutralization comprises at least one member selected from calcium oxide, calcium hydroxide and calcium carbonate. In the neutralization procedure, HCl produced, as a by-product of the polymerization reaction is neutralized and as a result, calcium chloride ($CaCl_2$) is necessarily produced. The amount of HCl produced as a by-product of the polymerization reaction is variable in response to the chemical structure of the target polymer and the average molecular weight of minimum repeating units of the polymer. For example, in the case where HCl produced as a by-product, by the polymerization reaction for poly-metaphenyleneisophthalamide, is completely neutralized by the above-mentioned compound, $CaCl_2$ is produced in an amount of 46.64 parts by weight per 100 parts by weight of the polymer. The $CaCl_2$ produced by the neutralization reaction is dissolved and retained in the polymer solution and serves as a promoter for increasing the stability of the polymer solution, as described in Japanese Examined Patent Publication No. 35-16,027. However, in the conventional process, the $CaCl_2$ dissolved in a large amount in the polymer solution causes the wet-spinning procedure, using the polymer solution, to be difficult.

The amount of water produced by the neutralization reaction and contained in the polymer solution is variable in response to the type of the neutralizing agent. When the neutralization is effected by using calcium hydroxide, water is produced in an amount of 15.13 parts by weight per 100 parts by weight of the polymer. Alternatively, when the neutralization is carried out by using calcium oxide or calcium carbonate, water is produced in an amount of 7.56 parts by weight per 100 parts by weight of the polymer. The neutralizing agent is added in the state of an aqueous solution or of a slurry containing water and a solvent, to the polymerization system, and thus both the produced water and the added water are contained in the resultant polymer solution. However, as long as water is contained in the above-mentioned amount, the stability of the polymer solution and the properties of the neutralized composition are substantially not degraded. Sometimes, the presence of water may advantageously cause the resultant polymer solution to exhibit a reduced viscosity. However, when the content of water is too high, the resultant polymer solution may undesirably exhibit a significantly decreased stability (may become gelled). Accordingly, the appropriate amount of water to be added in the neutralization procedure is variable in response to the concentration of the polymer. The addition amount of water is 15 parts by weight or more per 100 parts by weight of the polymer. Water can be dissolved in an amount of about 6 times the above-mentioned amount, namely about 90 parts by weight per 100 parts by weight of the polymer, in the polymer solution. However, the content of water at which the resultant polymer solution can be retained stable is in the range of from 2.42 to 9.7 parts by weight per 100 parts by weight of the polymer (water/polymer=15 to 60% by weight). Also, when PN concentration=20, the addition amount of water is about 15 to 60 parts per 100 parts of polymer, and is approximately equal to that when PN concentration=16. Further, the water content, at which the resultant polymer solution is retained stable, is 15 to 45 parts when PN concentration=25 and 15 to 30 parts when PN concentration=30. The above-mentioned water content values are determined by leaving the polymer solution to stand at a temperature of 60 to 70° C., and are somewhat variable in response to the polymerization degree of the polymer and the temperature of the polymer solution left to stand. The range of the water content at which the water can be dissolved in the polymer solution is restricted with an increase in the concentration of the polymer. In the practice of the process of the present invention, preferably the content of water in the polymer solution is preliminarily adjusted to 8% by weight or less, and then the appropriate water content is established by an experiment, to prevent the gellation of the polymer solution.

The polymer solution usable for the process of the present invention should be prepared from the above-mentioned starting materials. For example, a polymer solution prepared by the process in which the above-mentioned starting materials are reacted with each other in THF, the resultant reaction mixture is added with an aqueous alkali solution to neutralize hydrogen chloride produced in the interface between THF and the aqueous solution and the resultant polymer is dissolved in an amide compound solvent, may be employed for the present invention. Alternatively, a polymer solution prepared by an interface polymerization method may be employed.

In the conventional process for producing the meta-type aramid filaments, it was considered that the solution of the meta-type aramid polymer containing equimolar $CaCl_2$ which refers to the calcium chloride produced, when a poly-meta-aramid is produced by a solution polymerization method, in an equivalent molar amount to the amide residue, is difficult to convert to filaments by the wet-spinning method. Thus, in the production of the filaments from the meta-type aramid polymer solution, a dry-spinning method or a semi-dry, semi-wet spinning method is employed. Also, it was considered that to subject the above-mentioned polymer solution to the wet-spinning method, in each of the solution polymerization method, and the interface polymerization method, the content of chloride salts ($CaCl_2$, NaCl, $NH_4Cl$, etc) produced by neutralizing HCl produced as a by-product must be reduced to 70% or less, preferably 20% or less based on the total amount of the produced chloride salts, to prepare a polymer solution containing the salts at a reduced content.

However, usually, the removal of the chlorides by the above-mentioned means is difficult in industrial practice. For example, when the polymer is prepared by the interface polymerization, the solvent for the polymerization is different in type from the solvent for the polymer solution for the spinning, and thus two separate recovery apparatuses are necessary to recover the different solvents. Even in the case where the solution of the polymer prepared by the solution polymerization method is prepared by using the same solvent as the polymerization solvent, and the resultant polymer solution is subjected to the spinning procedure, difficult procedures such that the inorganic salts produced as a by-product in the neutralization procedure are removed from the polymer solution by filtration under pressure, which filtration is industrially very difficult because the polymer solution has a high viscosity, or such that the inorganic chlorides in the polymer solution are removed by adding and washing the polymer solution with water, then the polymer is dried and then dissolved, are necessary. Thus, the conventional process is disadvantageous in that the process cost is high and an environmental pollution occurs.

In the process of the present invention, meta-type aramid filaments having a high gloss, mechanical properties and heat resistance can be produced by using a wet-spinning procedure in which a polymer solution which may be a polymer solution containing equimolar $CaCl_2$, is extruded through a spinneret and the extruded polymer solution is directly introduced into a coagulation bath having a specific composition and containing substantially no salts.

In the wet-spinning step of the process of the present invention, the polymer solution is coagulated by using a coagulation bath having a very simple composition, consisting of an aqueous solution of an amide compound solvent, whereby porous undrawn filaments having a high uniformity can be obtained. Namely, in the process of the present invention, the temperature of the above-mentioned polymer solution is preferably controlled to a level in the range of from 20 to 90° C. and corresponding to the temperature of the coagulation bath, the temperature-adjusted polymer solution is extruded through the spinneret and directly introduced into the coagulation bath having the above-mentioned composition and temperature, to form undrawn porous filaments, then the undrawn filaments are withdrawn from the coagulation bath, and drawn in an aqueous solution of the amide compound solvent (preferably at a drawn ratio of 2 or more but not more than 10), the drawn filaments are washed with water, dried and further heat-treated.

The undrawn porous filaments produced from the polymer solution containing the inorganic ionic substances by the above-mentioned wet-spinning step are subjected to the same plasticizing drawing, water-washing and heat treatment steps as mentioned above and thereby meta-type wholly aromatic polyamide filaments having high bulk density and uniformity can be produced with a high efficiency at a high productivity.

By the above-mentioned embodiment of the process of the present invention, meta-type aramid filaments having a tensile strength of 3.53 cN/dtex (4.0 g/de) or more can be obtained.

In the process of the present invention, the wet-spinning, plasticizing drawing, washing, and drying and heat treatment procedures can be continuously carried out. This is an advantage of the process of the present invention. However, optionally, the process of the present invention may be carried out in a plurality of divided stages or in an order different to the above-mentioned order.

Further, the filaments produced by the process of the present invention are optionally further subjected to a crimping procedure and/or a cutting procedure in which the filaments are cut into a desired fiber length, a spinning procedure, etc.

<Filaments Produced by the Process of the Present Invention>

The meta-type wholly aromatic polyamide (meta-aramid) filaments produced in accordance with the process of the present invention have a dense structure similar to that of the conventional meta-aramid filaments, the bulk density of the filaments of the present invention is 1.2 g/cm$^3$ or more, preferably 1.3 g/cm$^3$ or more and exhibit good filament properties, and the content of the salts in the filaments can be controlled to a very low level. Namely, the total content of the inorganic ionic substances contained in the filaments can be restricted to 500 ppm or less, preferably 300 ppm or less. In the preferred embodiment, the content of calcium, which is considered to affect on the filament properties, the heat resistance and processability of the filaments, in the filaments, can be controlled to 0 to 100 ppm. Also, the content of chlorides in the filaments which is considered to affect on the electric properties, for example, electrically insulating property of the filaments, can be restricted to 0 to 150 ppm.

<Use of Filaments>

The meta-type wholly aromatic polyamide (meta-aramid) filaments produced in accordance with the process of the present invention exhibit excellent heat resistance, flame resistance and mechanical properties and can be used for various fields utilizing the above-mentioned properties and, particularly, are useful in fields in which contamination by ionic substances should be prevented. For example, the meta-type aramid filaments of the present invention are useful alone or in combination with other types of filaments for the production of woven and knitted fabrics usable as heat resistant, flame resistant clothes, for example, uniforms for fire men and protecting clothes, and fire resistant bedclothes and interior materials, and for the production of nonwoven fabrics which are usable for industrial materials, for example, filters, or synthetic paper sheets and composite materials. Alternatively, the meta-aramide filaments of the present invention having a controlled content of the ionic substances are usable for the fields of electrically insulating materials, parts of electronic devices and base boards for printed circuits, in the form of woven or knitted fabrics, nonwoven fabrics or synthetic paper sheets.

EXAMPLES

The present invention will be further explained by the following examples with reference to the comparative examples. These examples and comparative examples are only for the purpose of promoting understand of the present invention and are not intended to restrict the scope of the present invention.

In Example 1 and Comparative Example 1 shown below, the intrinsic viscosity (I.V.) of the aromatic polyamide polymer was determined by isolating the polymer from a polymer solution prepared by a polymerization procedure, drying the isolated polymer, and subjecting the dried polymer to the intrinsic viscosity measurement at a polymer concentration of 100 mg/100 ml in a concentrated sulfuric acid at a temperature of 30° C.

Also, the polymer solution used for the spinning procedure, the concentration of the polymer (PN concentration) is a weight % of the polymer based on the total weight of the polymer solution, namely, {(polymer weight)/(total polymer solution weight)}×100(%).

Further, the bulk density of the porous undrawn filaments prepared by the coagulation procedure was calculated from the diameter of the filaments determined in accordance with ASTM D 2130 and the filament thickness value (dtex value) of the filaments. Also, the bulk density of the drawn, heat-treated filaments was measured by the sink-float method using, as a solvent, a mixture of tetrachloroethane and cyclohexane.

In the resultant filaments, the content of metals was measured by using atomic-absorption spectroscopy for alkali metals or ICP for other metallic ions.

The content of inorganic chlorides in the filaments was determined by DOMAN microgravimetric quantitative analysis.

Example 1

(a) Preparation of Polymer Solution

A polymer solution was prepared by the following procedures in accordance with the interface polymerization method described in Japanese Examined Patent Publication No. 47-10,863.

Isophthalic acid chloride and metaphenylenediamine in the same amounts as each other are dissolved in tetrahydrofuran (THF), the resultant solution was brought into contact with an aqueous sodium carbonate solution to effect an interface polymerization. The resultant polymer was washed to obtain poly-metaphenyleneisophthalamide in the form of a powder. This poly-metaphenyleneisophthalamide exhibited an intrinsic viscosity of 1.9. The poly-metaphenyleneisophthalamide powder in an amount of 21.5 parts by weight was suspended in 78.5 parts by weight of N-methyl-2-pyrrolidone cooled 0° C., to prepare a slurry of the polymer. The polymer slurry was heated to a temperature of 60° C. to provide a transparent polymer solution. The inorganic ion contents of the above-mentioned polymer powder were Na: 730 ppm, K: 8.8 ppm, Ca: 5 ppm and Fe: 2.3 ppm. Also, in the above-mentioned polymer solution, the concentration of the polymer was 21.5%.

(b) Wet-spinning Step

The polymer solution prepared in the above-mentioned step (a) was extruded, as a wet-spinning liquid, through a spinneret having 50 spinning holes having a hole diameter of 0.05 mm, and introduced into a coagulation bath at a bath temperature of 80° C. to coagulate the introduced polymer solution streams and to form undrawn filaments. The coagulation bath had a composition comprising water and NMP in a weight ratio of 45/55, and in the coagulation bath, the filament immersion length (effective coagulation bath length) was 60 cm, and the travelling speed of the undrawn filament was 8 m/minute. The undrawn filaments were withdrawn from the coagulation bath to the ambient air atmosphere.

The undrawn filaments were porous and in a linear form and had a bulk density of 0.65 g/cm$^3$.

(c) Plasticizing Drawing Step to Dry, Heat-treatment Step

The above-mentioned undrawn filaments were introduced into a plasticizing drawing bath and drawn at a draw ratio of 3. The plasticizing drawing bath used had a composition comprising water and NMP in a weight ratio of 70/30 and the temperature of the bath was 80° C. After the drawing step, the drawn filaments was introduced into a water-washing bath in which the drawn filaments were fully washed with cold water and then with hot water at a temperature of 80° C. Then, the water-washed filaments were dried by winding around a periphery of a drying roller having a periphery temperature of 120° C. The dried filaments were withdrawn from the drying roller and dry-drawn in a draw ratio of 1.2 on a heating plate at a temperature of 340 to 360° C. to heat-treat the drawn filaments. The heat-treated filaments were finally wound up. In this example, the total drawn ratio was 3.6, and the final winding up speed of the heat-treated filaments was 28.8 m/minutes.

(d) Filament Properties

The mechanical properties of the resultant poly-metaphenyleneisophthalamide filaments were measured. As a result, the filaments had a thickness of 1.89 dtex (1.7 denier), a bulk density of 1.3 g/cm$^3$, a tensile strength of 3.11 cN/dtex (3.52 g/de) an ultimate elongation of 24.5%, and a Young's modulus of 61.1 cN/dtex (69.2 g/de). These mechanical properties were good. The resultant filaments had ion contents as shown in Table 1. The ion contents were very low.

TABLE 1

Meta-type aramid filaments of Example 1

| Types of ions | Contents (ppm) |
|---|---|
| Na | 75 |
| K | 6.8 |
| Ca | 5.0 |
| Fe | 7.7 |
| Cl | 110 |
| Total of ionic substances | 218 |

Comparative Example 1

For comparison, the ion contents of conventional poly-metaphenyleneisophthalamide filaments available under the trademark of CORNEX from TEIJIN LTD. were measured. The results are shown in Table 2.

TABLE 2

| Type of ions | Content (ppm) |
|---|---|
| Na | 80.0 |
| K | 7.0 |
| Ca | 1200 |
| Fe | 8.0 |
| Cl | 2500 |
| Total ionic substances | 5000 |

In each of Examples 2 and 3 shown below, the intrinsic viscosity (I.V.) of the aromatic polyamide polymer was measured by a method such that the polymer was isolated from a polymer solution and dried, the resultant polymer was dissolved in a polymer concentration of 0.5 g/100 ml in concentrated sulfuric acid and the polymer solution was subjected to an intrinsic viscosity determination at a temperature of 30° C. The polymer concentration (PN concentration) of the polymer solution fed to the spinning step was a ratio in % of the weight of the polymer to the total weight of the polymer solution, namely (polymer/polymer solution in %, and the contents of calcium chloride and water in the polymer solution were indicated in parts by weight per 100 parts by weight of the polymer, respectively.

Also, the density of the porous filamentary products obtained by the coagulation was a bulk density calculated from the diameter of the filaments and the filament thickness (dtex) measured in accordance with ASTM D 2130, the density of the drawn, heat-treated filaments was determined by the sink-float method using a solvent consisting of a mixture of tetrachloroethane and cyclohexane.

Example 2

(a) To prepare a polymer solution by a solution polymerization method, a reaction vessel equipped with a controlling thermometer, a stirrer and inlets for starting materials was charged with 815 parts by weight of NMP dehydrated by using molecular sieves, then meta-phenylenediamine (mPDA) in an amount of 108 parts by weight was dissolved in the NMP and the resultant solution was cooled to a temperature of 0° C. Into the cooled diamine solution, 203 parts by weight of isophthalic acid chloride (IPC) refined by distillation and pulverized in a nitrogen gas atmosphere were mixed, while stirring the mixture, to cause the diamine and the acid chloride to react with each other. The reaction temperature of the reaction system was increased to about 50° C.; the reaction system was maintained at this temperature for 60 minutes while continuing the stirring; the reaction system temperature was increased to 60° C.; and reaction was continued at this temperature for 60 minutes. After the reaction was completed, 70 parts by weight of calcium hydroxide in the form of fine particles were placed in the reaction vessel and dissolved in the reaction system to neutralize the reaction system (primary neutralization). Further, 4 parts by weight of calcium hydroxide were dispersed in 83 parts by weight of NMP to provide a slurry. The calcium hydroxide-containing slurry (neutralizing agent) was mixed into the primary-neutralized polymer solution, while stirring the resultant mixture (secondary neutralization). The secondary neutralization was carried out at a temperature of 40 to 60° C. for about 60 minutes while stirring the mixture. The calcium hydroxide was completely dissolved to provide a neutralized polymer solution.

The resultant polymer solution (spinning liquid) had a polymer concentration (PN concentration, namely a value of part by weight of the polymer per 100 parts by weight of the total of the polymer and NMP) of 14; the I.V. of the resultant poly-metaphenyleneisophthalamide was 2.4. Also, in the polymer solution, the content of calcium chloride was 46.6 parts and the content of water was 15.1 parts per 100 parts by weight of the polymer.

(b) Wet-spinning, Plasticizing Drawing, Water-washing, Drying and Heat-treatment Steps The above-mentioned spinning liquid (a) was extruded through a spinneret having 50 spinning holes each having a hole diameter of 0.09 mm and introduced into a coagulation bath at a bath temperature of 80° C. to prepare undrawn filaments. The coagulation bath had a composition comprising water and NMP in a mixing weight ratio of 50/50, and an immersion length (effective coagulation bath length) of 60 cm. The travelling speed of the undrawn filaments in the coagulation bath was 8 m/minute. The coagulated undrawn filaments were withdrawn from the coagulation bath to the ambient atmosphere. The resultant porous undrawn filaments withdrawn from the coagulation bath had a bulk density of 0.74. The undrawn filaments were successively introduced into a plasticizing drawing bath and drawn in the bath at a draw ratio of 3.0. The plasticizing drawing bath had a composition comprising water and NMP at a mixing draw ratio of 45/55, and a temperature of 40° C. The drawn filaments were fully washed with cold water and then with hot water at a temperature of 80° C. Then, the washed drawn filaments were dried on a drying roller having a periphery temperature of 120° C., and then dry heat-drawn on a heating plate at a temperature of 340 to 360° C. at a draw ratio of 1.2, and then heat-treated filaments were wound up. In this example, the total draw ratio was 3.6, and the final winding up speed of the heat-treated filaments was 28.8 m/minute.

The mechanical properties of the resultant drawn poly-metaphenyleneisophthalamide filaments were measured. As results, the filaments had a filament thickness of 1.89 dtex (1.7 d de) a bulk density of 1.33, a tensile strength of 3.62 cN/dtex (4.1 g/de), a ultimate elongation of 38% and a Young's modulus of 86.5 cN/dtex (98 g/de). These mechanical properties were considered good.

Example 3

The same polymer solution as in Example 1 was subjected to a wet-spinning step in which the polymer solution was extruded through a spinneret, having 500 spinning holes each having a hole diameter of 0.09 mm, and introduced into a coagulation bath at a bath temperature of 80° C. to form porous undrawn filaments. The coagulation bath had a composition comprising water and NMP at a mixing weight ratio of 45/55 and, also, the plasticizing drawing bath which will be explained below had a composition comprising water and NMP in a mixing weight ratio of 45/55.

In the coagulation bath, the immersion length of the undrawn filaments was 50 cm and the forwarding speed of the undrawn filaments was 8 m/minute. The undrawn filaments were subjected to the same plasticizing drawing step, water-washing step, drying step and dry heat drawing step as those in Example 1. Poly-metaphenyleneisophthalamide filaments were obtained. The porous undrawn filaments withdrawn from the coagulation bath had a bulk density of 0.82. The properties of the drawn, heat-reacted filaments were measured. As results, the heat-treated filaments had a thickness of 2.11 dtex (1.9 de), a bulk density of 1.32, a tensile strength of 3.71 cN/dtex (4.2 g/de), an ultimate elongation of 21% and a Young's modulus of 84.7 cN/dtex (96 g/de). These properties were considered good.

In accordance with the process of the present invention, the dense meta-type wholly aromatic polyamide filaments (particularly poly-metaphenyleneisophthalamide filaments) having good mechanical properties, and heat resistance and containing substantially no salts or containing the salts, can be produced with high productivity. The meta-type wholly aromatic polyamide filaments substantially not containing inorganic ionic substances, namely having a ultimately low concentration of the inorganic ionic substance have excellent electric performance, in addition to excellent heat resistant, flame retardant and electrically insulating properties which are characteristic for the filaments, and thus are useful as a material for electronic devices.

Also, in accordance with the process of the present invention, meta-type aramid filaments having excellent mechanical properties and high heat resistance and flame retardance can be produced at a high productivity by passing a meta-type polyamide polymer solution which was produced by a solution polymerization method and from which the inorganic ionic substances were not separated, through a procedure in which the polymer solution was extruded and directly introduced into a coagulation bath comprising an amide compound solvent and water to cause the introduced polymer solution to be coagulated into the form of porous undrawn filaments.

What is claimed is:

1. A process for producing meta-type wholly aromatic polyamide filaments comprising the steps of preparing a polymer solution by dissolving a meta-type wholly aromatic polyamide comprising, as principal repeating units, metaphenylene diamine isophthalamide units in an amide compound solvent; subjecting the polymer solution to a wet-spinning procedure to form undrawn filaments; drawing the undrawn filaments; washing the resultant drawn filaments with water; and heat-treating the washed filaments, wherein (1) in the wet-spinning step, the polymer solution is extruded in the form of filamentary streams into a coagulation bath comprising an amide compound-containing solvent and water but substantially not comprising salts, through spinning orifices of a spinneret, to coagulate the filamentary polymer solution streams in the coagulation bath and to form coagulated porous undrawn filaments, and (2) in the drawing step, the coagulated porous undrawn filaments are drawn in a plasticizing drawing bath comprising an aqueous solution of an amide compound solvent.

2. The process for producing meta-type wholly aromatic polyamide filaments as claimed in claim 1, wherein the meta-type wholly aromatic polyamide contains the repeating metaphenylenediamine isophthalamide units in a molar amount of 90 to 100 molar % based on the total molar amount of all of the repeating units.

3. The process for producing meta-type wholly aromatic polyamide filaments as claimed in claim 1, wherein the coagulation bath used in the wet-spinning step contains the amide compound solvent and water in a mixing weight ratio within the range of from 20/80 to 70/20.

4. The process for producing meta-type wholly aromatic polyamide filaments as claimed in claim 1, wherein, in the wet-spinning step, the bulk density of the resultant coagulated porous undrawn filaments is controlled to from 0.3 to 1.0 g/cm$^3$.

5. The process for producing meta-type wholly aromatic polyamide filaments as claimed in claim 1, wherein the amide compound solvent and the water, in the drawing bath, are present in a mixing weight ratio within the range of from 20/80 to 70/30.

6. The process for producing meta-type wholly aromatic polyamide filaments as claimed in claim 1, wherein in the drawing step, the drawing bath has a temperature of 20 to 90° C., and the coagulated porous undrawn filaments is drawn at a draw ratio of from 1.5 to 10.

7. The process for producing meta-type wholly aromatic polyamide filaments as claimed in claim 1, wherein, in the heat-treating step, the drawn, water-washed filaments are further drawn at a temperature in the range of from 250 to 400° C. at a draw ratio in the range of from 0.7 to 4.0.

8. The process for producing meta-type wholly aromatic polyamide filaments as claimed in claim 1, wherein the amide compound solvent contained in the polymer solution and the amide compound solvent contained in the coagulation bath respectively and independently from each other comprise at least one member selected from the group consisting of N-methyl-2-pyrrolidone, dimethylacetamide, dimethylformamide and dimethylimidazolidinone.

9. The process for producing meta-type wholly aromatic polyamide filaments as claimed in claim 1, wherein the heat-treated filaments have a bulk density of 1.2 or more.

10. The process for producing meta-type wholly aromatic polyamide filaments as claimed in claim 1, wherein the total content of inorganic ionic substances contained in the polymer solution for the wet-spinning step, is controlled to 0.1% by weight or less.

11. The process for producing meta-type wholly aromatic polyamide filaments as claimed in claim 1, wherein the polymer solution for the wet-spinning step is prepared by poly-condensing an aromatic diamine compound with an aromatic dicarboxylic acid chloride, and neutralizing hydrogen chloride produced, as a by-product, with a basic calcium compound, and comprises the meta-type wholly aromatic polyamide, calcium chloride and water.

* * * * *